United States Patent [19]

Smith et al.

[11] 4,273,173

[45] Jun. 16, 1981

[54] DEVICE FOR TRANSMITTING TORQUE

[75] Inventors: Lloyd T. Smith; Alan E. Bartholomew, both of Newton; Robert W. Fee; Michael L. Meister, both of Wichita; Richard J. Robbins, Derby; Richard E. Ten Eyck, Wichita, all of Kans.

[73] Assignee: S/V Tool Company, Inc., Newton, Kans.

[21] Appl. No.: 85,812

[22] Filed: Oct. 17, 1979

[51] Int. Cl.[3] ..... B25G 1/08

[52] U.S. Cl. ..... 81/177 M; 81/438; 145/62

[58] Field of Search ..... 145/62, 63, 50 C, 50 B

[56] References Cited

U.S. PATENT DOCUMENTS

| | | | |
|---|---|---|---|
| 273,621 | 3/1883 | Small | 145/62 |
| 537,246 | 4/1895 | Stone | 145/62 |
| 666,510 | 1/1901 | Furbish | 145/62 |
| 707,901 | 8/1902 | Cheney | 145/62 |
| 2,378,775 | 6/1945 | Johnson | 145/50 C |
| 3,667,518 | 6/1972 | Stillwagon | 145/62 |
| 3,683,984 | 8/1972 | Hull | 145/62 |

FOREIGN PATENT DOCUMENTS

| | | | |
|---|---|---|---|
| 138190 | 1/1949 | Australia | 145/62 |
| 596539 | 8/1925 | France | 145/50 C |

*Primary Examiner*—Stephen G. Kunin
*Assistant Examiner*—J. T. Zatarga
*Attorney, Agent, or Firm*—Schmidt, Johnson, Hovey & Williams

[57] ABSTRACT

A screwdriver or the like has a shank adapted to hold any one of a number of double ended bits together with a handle for the shank having storage slots for those bits not being held in place by the shank. A split ring, rotatable on the stem of the handle, holds the stored bits against displacement until the ring is rotated to place the space between the ends of the ring into alignment with a selected slot.

1 Claim, 6 Drawing Figures

DEVICE FOR TRANSMITTING TORQUE

Compound torque transmitting devices by their very nature, utilize any one of a number of bits of differing characteristics as may be selected by the user for releasable attachment to the shank of the tool. The popularity of hand tools of that type is diminished somewhat by the fact that the separate bits oftentimes become lost or misplaced because of the lack of a satisfactory place of storage in conjunction with the tool box or the like where the tool is normally kept during non-use.

In accordance with our present invention, therefore, a specially formed handle presents a stem that is particularly adaptable as a bit storage medium. Accordingly, a number of slots is provided in the stem for the bits and a ring-like retainer around the stem is rotatable to positions rendering selected bits readily available from their storage slots.

Figure 1:
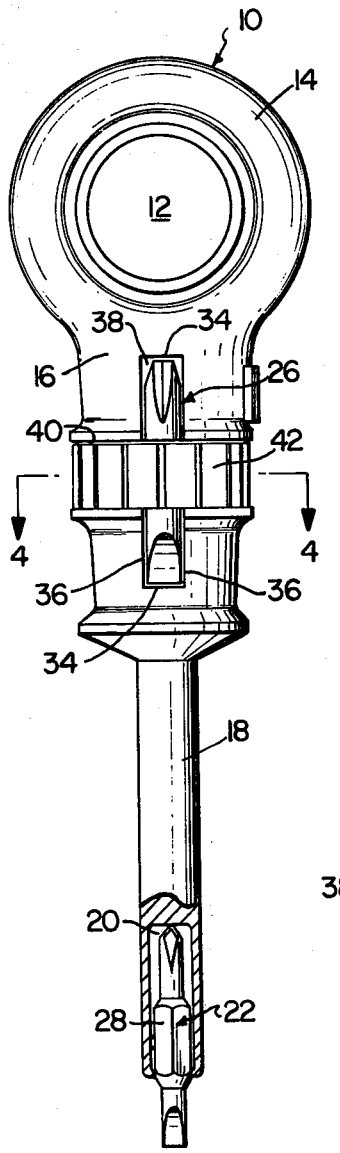
FIG. 1 is a side-elevational view of a device for transmitting torque made pursuant to our present invention.
Figure 3:
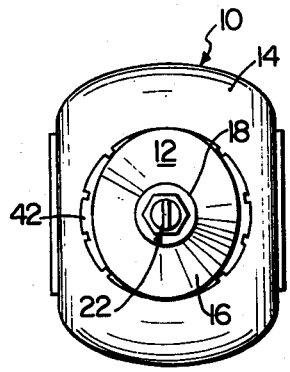
FIG. 3 is a view from the bit end of the device.
Figure 2:
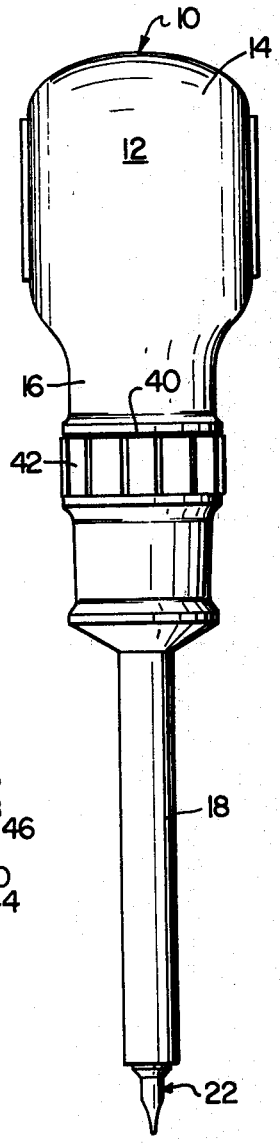
FIG. 2 is a view similar to FIG. 1 taken at right angles to the latter.
Figure 4:
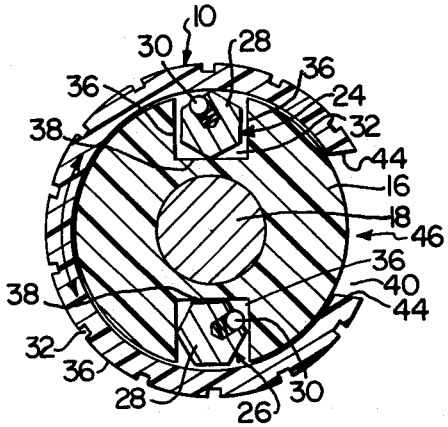
FIG. 4 is a transverse cross-sectional view on an enlarged scale taken along line 4—4 of FIG. 1.
Figure 5:
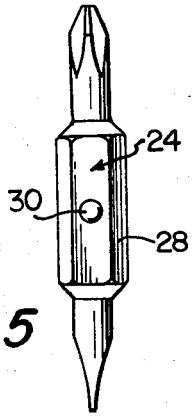
FIG. 5 is an elevational view on an enlarged scale of one of the bits stored in the stem of the device.
Figure 6:
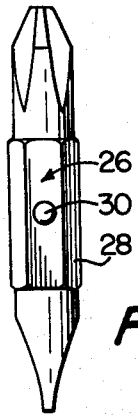
FIG. 6 is a view similar to FIG. 5 showing another of said bits.

The compound torque-transmitting device 10 shown in the drawing has a handle 12 which includes a ball-like portion 14 having an elongated, integral stem 16 to which is secured an elongated shank 18 provided with a holder 20 for any one of a plurality of differing types and/or sizes of elongated turning tools 22, 24 and 26. While such tools, as shown, are double ended screwdriver bits, the term "bit", as herein contemplated, includes any replaceable part that actually performs the function for which the device 10 is designed, including drilling and boring, as well as parts for holding, twisting or turning such objects as bolts and nuts, e.g. socket drivers.

The holder 20 is in the nature of an internally ribbed cavity in that end of the shank 18 opposite the stem 16 into which either end of the bits 22, 24 or 26 may be inserted, each of the latter having an intermediate transversely polygonal section 28 that is provided with a spring-loaded detent 30 which engages the ribs of the holder 20.

A pair of elongated, diametrically opposed, outwardly opening tool storage slots 32 in the stem 16 are each provided with end walls 34, side walls 36 and a base wall 38, and each slot 32 extends longitudinally of the stem 16.

A groove 40 around the stem 16 intersects the slots 32 and rotatably receives a resilient, essentially C-shaped retainer ring 42 which yieldably engages the stem 16 within the bottom of the groove 40. The ends 44 of the ring 42 present a tool access space 46 which may be aligned with either of the slots 32 upon rotation of the ring 42. When the tools 22, 24 or 26 are normally in the slots 32 they are restrained by the walls 34, 36 and 38 and by the ring 42 across the section 28. The width of the band-like ring 42 is substantially the same as the width of the groove 40 such that the ring 42 cannot be displaced except by expanding the ring 42 to a larger than normal diameter.

From the foregoing it can now be appreciated that advantageous use is being made of a handle 12 which has a stem 16 especially adaptable for use as a storage for the bits, all without adverse interference with normal use of the device 10 upon grasping the portion 14 of the handle 12. The bits are readily accessible and the problem of lost or displaced bits is satisfactorily and advantageously solved without adding appreciably to costs or detracting from appearance, weight or balance.

We claim:

1. In a torque transmitting device, an elongated stem provided with an enlarged, integral handle;

a shank secured to the stem in axial alignment therewith, said shank extending from the stem oppositely from said handle, said stem being provided with an elongated, outwardly-opening, tool-storing slot extending longitudinally of the stem between the handle and the shank, said slot terminating in a pair of opposed, spaced-apart, radial end walls, one being spaced from the shank and facing toward the handle, the other being adjacent the handle and facing toward the shank, presenting stops for precluding displacement of the tool longitudinally of the slot, said stem having an outwardly-opening, circumferential groove between the handle and the shank of lesser depth than the slot, said groove intersecting the slot and otherwise surrounding the stem, the slot being otherwise uninterrupted between said ends thereof; and a C-shaped, tool-retaining, band-like ring confined in said groove and rotatable about the axis of the stem, said ring being substantially equal in width to the width of the groove, and having a pair of opposed ends, presenting a space therebetween alignable with the slot upon rotation of the ring, and through which the tool may be inserted into and removed from the slot.

* * * * *